US009079645B2

(12) United States Patent
Barbis

(10) Patent No.: US 9,079,645 B2
(45) Date of Patent: Jul. 14, 2015

(54) FOLDABLE FLOTATION DEVICE

(75) Inventor: Richard A. Barbis, Eugene, OR (US)

(73) Assignee: Swimways Corporation, Virginia Beach, VA (US)

( * ) Notice: Subject to any disclaimer, the term of this patent is extended or adjusted under 35 U.S.C. 154(b) by 435 days.

(21) Appl. No.: 13/135,383

(22) Filed: Jul. 1, 2011

(65) Prior Publication Data

US 2013/0005203 A1 Jan. 3, 2013

(51) Int. Cl.
*B63C 9/11* (2006.01)

(52) U.S. Cl.
CPC ..... *B63C 9/11* (2013.01)

(58) Field of Classification Search
CPC ..... B63C 9/11; B63C 9/115; B63C 9/125; B63C 9/1255; B63C 9/13; B63C 9/135; B63C 9/15; B63C 9/155; A41D 13/012; A41D 13/0125
USPC ..... 441/88, 106–119
See application file for complete search history.

(56) References Cited

U.S. PATENT DOCUMENTS

| | | | | |
|---|---|---|---|---|
| 2,377,865 A | | 6/1945 | Coombs | |
| 2,692,994 A | * | 11/1954 | King et al. | 441/110 |
| 3,225,369 A | | 12/1965 | Berwick | |
| 4,097,947 A | | 7/1978 | Kiefer | |
| 4,863,409 A | | 9/1989 | Johnson et al. | |
| 5,514,019 A | * | 5/1996 | Smith | 441/88 |
| 5,632,235 A | | 5/1997 | Larsen et al. | |
| 5,766,114 A | | 6/1998 | Campbell | |
| 5,855,497 A | | 1/1999 | French | |
| 6,524,145 B1 | | 2/2003 | Arzate | |
| 6,582,267 B1 | * | 6/2003 | Steger | 441/112 |
| 6,659,824 B1 | | 12/2003 | McCormick | |
| D497,965 S | | 11/2004 | Barbis | |
| 7,195,529 B1 | | 3/2007 | Crandall | |
| 7,331,836 B1 | | 2/2008 | Harris | |
| 7,559,816 B2 | * | 7/2009 | Marshall | 441/108 |
| 7,559,817 B2 | | 7/2009 | Von Zell | |
| D604,788 S | | 11/2009 | Barbis et al. | |
| D606,151 S | | 12/2009 | Barbis et al. | |
| D606,152 S | | 12/2009 | Barbis et al. | |
| D622,800 S | | 8/2010 | Barbis | |
| D622,801 S | | 8/2010 | Barbis | |

(Continued)

FOREIGN PATENT DOCUMENTS

| | | | | |
|---|---|---|---|---|
| DE | 19953689 A1 | * | 5/2001 | A62B 37/00 |
| JP | 2003 313707 A | | 11/2003 | |

OTHER PUBLICATIONS

Machine translation of JP 2003-313707 A.*

(Continued)

*Primary Examiner* — Ajay Vasudeva

(57) ABSTRACT

A vest type flotation device having means for holding the flotation device in a folded configuration for transport and storage. In one embodiment a transport and storage strap member is attached substantially at its outer end to one of the right and left sides. The transport and storage strap member has a first portion of a first releasable locking member set attached thereto adjacent its inner end. A second portion of the first releasable locking member set is attached to one of the right and left front portions of the device. A second portion of a second releasable locking member set is attached to the right or left side of the device opposite the side to which the outer end of the transport and storage strap member is attached.

15 Claims, 4 Drawing Sheets

(56) References Cited

U.S. PATENT DOCUMENTS

| | | | |
|---|---|---|---|
| D638,083 | S | 5/2011 | Barbis |
| D638,084 | S | 5/2011 | Barbis |
| D638,085 | S | 5/2011 | Barbis |
| D650,033 | S | 12/2011 | Barbis |
| D663,003 | S | 7/2012 | Barbis |
| D667,911 | S | 9/2012 | Barbis |
| 8,262,426 | B1 | 9/2012 | Barbis |
| 2005/0106962 | A1 | 5/2005 | Johnson |
| 2007/0135005 | A1 | 6/2007 | Whitney |
| 2010/0136863 | A1 | 6/2010 | Vick |

OTHER PUBLICATIONS

International Search Report and Written Opinion for PCT/US12/44608, mailed on Sep. 27, 2012, 11 pages.
U.S. Appl. No. 13/601,041, filed Aug. 31, 2012, 13 pages.
U.S. Appl. No. 29/373,200, filed Mar. 15, 2011, 2 pages.
U.S. Appl. No. 29/432,288, filed Sep. 14, 2012, 6 pages.

* cited by examiner

FOLDABLE FLOTATION DEVICE

BACKGROUND OF THE INVENTION

The present invention relates to vest type flotation devices, such as a life jackets and swim assist vests, having means for holding the flotation device in a folded configuration for transport and storage.

Life jackets and swim assist vests are types of flotation device intended to keep the wearer on the surface of a body of water, either while swimming or after accidentally falling into the water from a water craft. Such vests typically are wrapped around the user's torso with the user's arms extending through arm openings and the two front portions fastened together with a vertically extending zipper and horizontally extending straps whose adjacent ends can be fastened together with a buckle or the like.

Such devices are bulky and occupy much space when not in use, such as during transportation or storage.

SUMMARY OF THE INVENTION

It is an object of the present invention to provide a flotation device such as a life jacket or swim assist vest with means that can be used to retain the flotation device in a folded configuration when not in use. By "folded configuration" is meant the configuration achieved when the device is folded substantially along its longitudinal center line with the right and left sides being brought towards each other and substantially into abutment The type of flotation device to which the present invention pertains has right and left front portions, a rear portion, and right and left sides formed at the juncture of the rear portion and the right and left front portions, respectively.

In a first embodiment a transport and storage strap member is attached substantially at its outer end to one of the right and left sides.

The transport and storage strap member has a first portion of a first releasable locking member set attached thereto adjacent its inner end. A second portion of the first releasable locking member set is attached to that one of the right and left front portions of the device adjacent the side to which the transport and storage strap member is attached. The first and second portions of the first releasable locking member set are configured to lockingly engage to retain the transport and storage strap member substantially in contact with the front of the flotation device during use.

A second portion of a second releasable locking member set is attached to the right or left side of the device opposite the side to which the outer end of the transport and storage strap member is attached. The first and second portions of the second releasable locking member set are configured to lockingly engage when the transport and storage strap is disengaged from the second portion of the first locking member set, twisted approximately 180 degrees about its longitudinal axis, and stretched across the back of the flotation device after the flotation device has been placed in its folded configuration.

In a second embodiment, the strap member is replaced with first and second releasable locking member portions are located on opposite sides of the device.

In a third embodiment, the strap member is replaced with an elastic loop member which can be stretched around the folded flotation device to hold it in its folded configuration.

DESCRIPTION OF PREFERRED EMBODIMENTS

Figure 1:
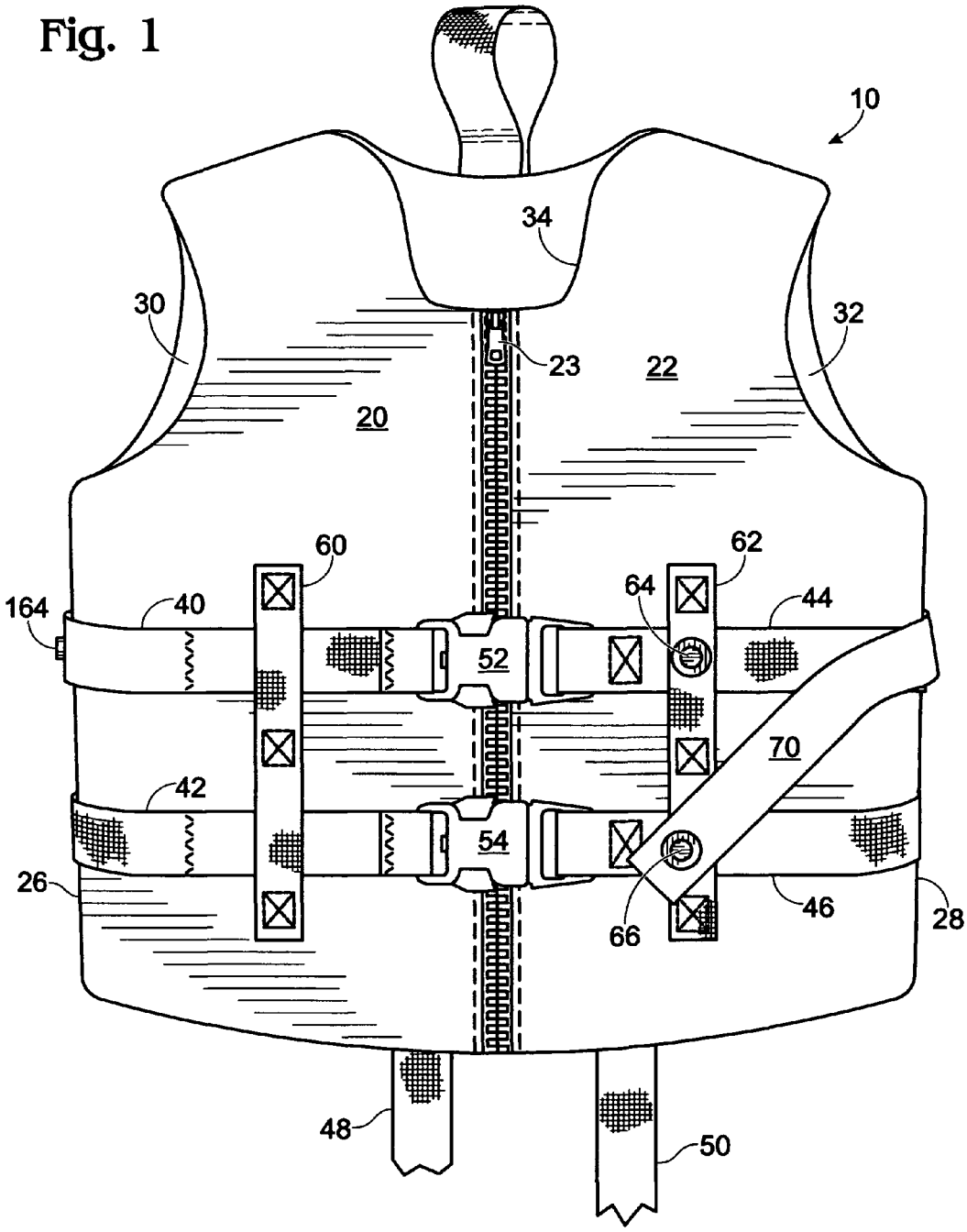
FIG. 1 is a view of the front side of a vest type flotation device incorporating the first embodiment of the transport and storage holding means of the present invention.

The vest type flotation device 10 includes right and left front portions 20 and 22, a back side 24, right and left arm openings 30 and 32, a collar portion 34, upper and lower right side horizontal waist straps 40 and 42, upper and lower left side horizontal waist straps 44 and 46, and leg straps 48 and 50 (only partially shown).

The right and left front portions 20 and 22 are attached to the back side 24 along right and left seams 26 and 28. The outer ends of upper and lower right side horizontal waist straps 40 and 42 are attached to the right side of the flotation device 10, preferably by being sewn into right seam 26. Similarly, the outer ends of upper and lower left side horizontal waist straps 44 and 46 are attached to the left side of the flotation device 10, preferably by being sewn into left seam 28.

The right and left front portions 20 and 22 can be removably attached together, such as by a zipper 23 or a hook and loop fastener (not shown).

The inner ends of upper and lower left side horizontal waist straps 44 and 46 have attachment means such as the female portions of releasable snap buckles 52 and 54 attached thereto. The inner portion of upper right side horizontal waist strap 40 is adjustably attached to the male portion of snap buckle 52, and the inner portion of lower right side horizontal waist strap 42 is adjustably attached to the male portion of snap buckle 54, all as well known in the snap buckle art.

Upper and lower right side horizontal waist straps 40 and 42 are adjustably held in place by a vertically disposed right support member 60 attached there over, and upper and lower left side horizontal waist straps 44 and 46 are held in place by a vertically disposed left support member 62 attached there over.

In a first embodiment the male portion 64 of a first button snap set is attached to left support member 62 at its intersection with upper left side horizontal waist strap 44.

A transport and storage strap 70 is attached at its outer end to the left side of life jacket 10, preferably by being sewn into left seam 28 joining the left front portion 22 and back side 24. The inner end of transportation and storage strap 70 has the female portion 66 of a first button snap set attached thereto, the female portion 66 of the first button snap set facing downwardly towards left front portion 22 and at a location that allows the female portion 66 to engage the male portion 64 without any substantial sagging or stretching of transportation and storage strap 70.

During use of flotation device 10 the male and female portions 64 and 66 of the first button snap set are releasably engaged so that transport and storage strap 70 is restrained from dangling.

Figure 2:
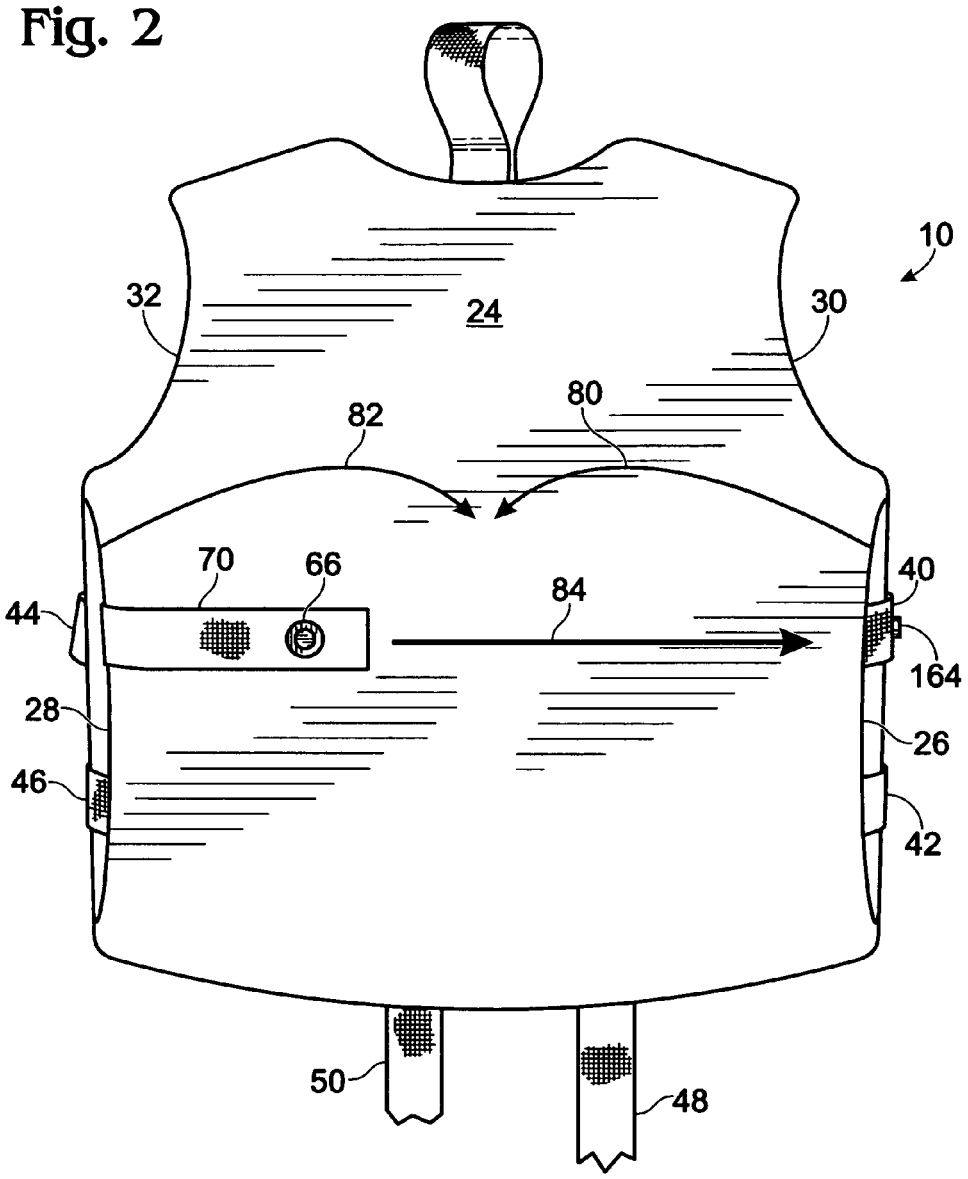
FIG. 2 is a view the back side of the flotation device employing the first embodiment.

When it is desired to transport or store flotation device 10, the male and female portions 64 and 66 of the first button snap set are disengaged and transport and storage strap 70 is rotated approximately 360 degrees about its juncture with left seam 28 to the back side 24 of life jacket 10, as seen in FIG. 2. The right and left seams 26 and 28 are then folded towards each other along the mid-portion of the back side 24 of flotation device 10, in the direction shown by arrows 80 and 82, which allows transport and storage strap 70 to be moved towards the right seam 26 in the direction shown by arrow.

Transport and storage strap 70 has a length such that when the backsides of right and left seams 26 and 28 are substantially folded into contact the female portion 66 and the male portion 164 can be brought into alignment.

Figure 3:
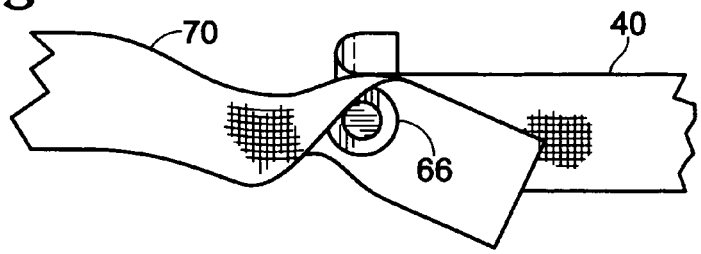
FIG. 3 is a partial view of the transport and storage strap of the first embodiment in use.

As shown in FIG. 3, transport and storage strap 70 is twisted substantially 180 degrees to allow the female portion 66 of the button snap located on the outer end thereof to be brought into alignment with the male portion 164 of a second button snap set located adjacent the outer end of upper right side horizontal strap 40. The male portion 164 and the female portion 66 of the second button snap set can then be snapped together into a releasable locking engagement which causes transportation and storage strap 70 to hold flotation device 10 in a folded, compressed configuration (not shown).

It is preferred to fold the back side 24 of flotation device 10 rather than the front side (the front side being comprised of right and left front portions 20 and 22) for several reasons. One reason such a configuration is preferred is that the present invention is preferably used in association with a flotation device having a fin projecting from the back side thereof, such as, for example, shown in the present inventor's U.S. Design Pat. No. D 606,151. Another reason is that the front is thicker due to flotation inserts and straps with associated buckles. However, if the flotation device does not have a fin projecting from the rear thereof, the right and left front portions 20 and 22 could be folded towards each other and strap 70 stretched across the front side to bring button snap portions 66 and 164 into alignment without having to twist strap 70.

Although it is preferred to employ button snaps having a female portion 66 and male portions 64 and 164 to secure transport and storage strap 70 to flotation device 10, other releasable fastening members having mating male and female members could be employed, including snap buckles such as 52 and 54.

Figure 4:
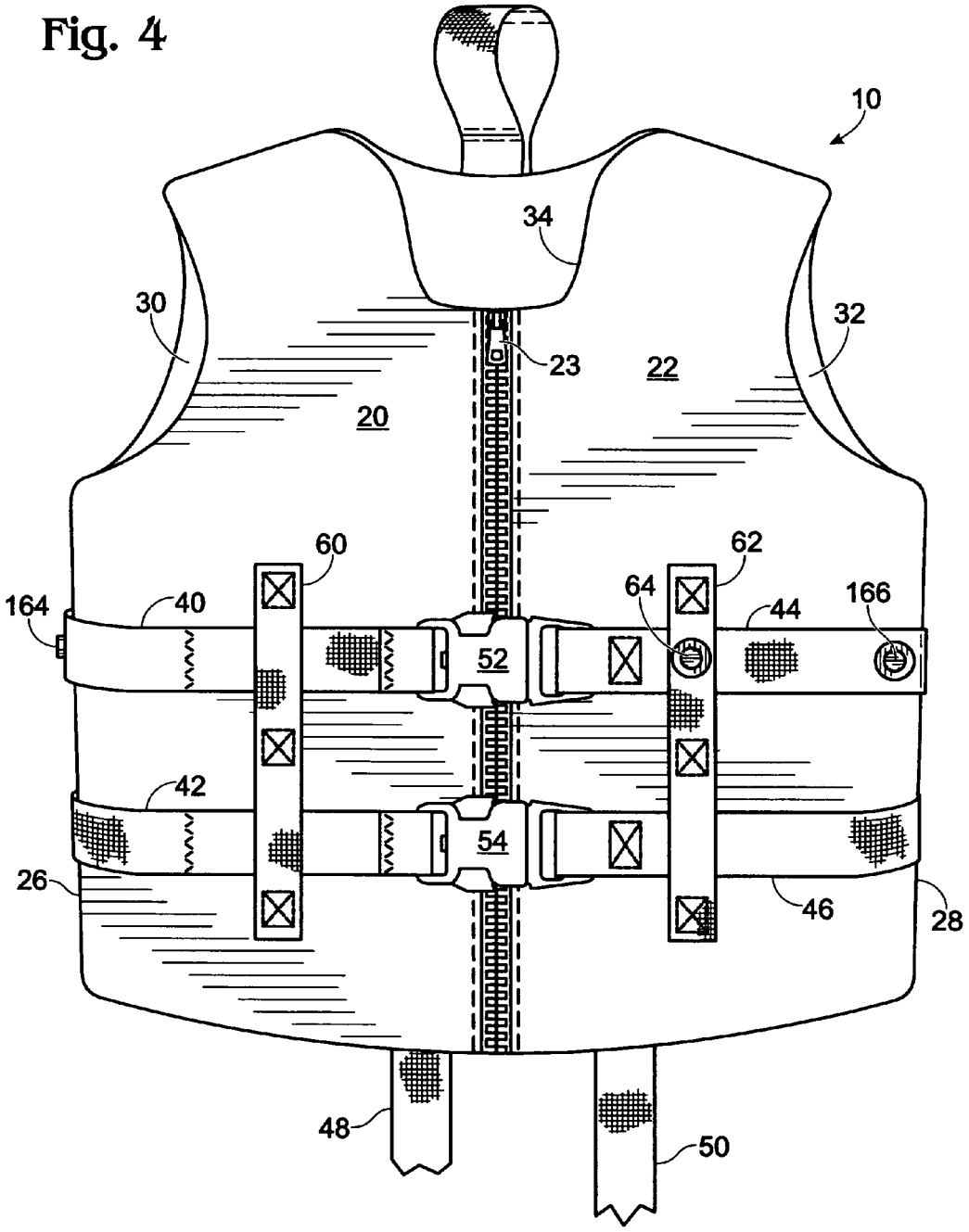
FIG. 4 is a view of the front side of a vest type flotation device incorporating the second embodiment of the transport and storage holding means of the present invention.

A second embodiment of the present invention is shown in FIG. 4. In this embodiment strap 70 of the first embodiment has been eliminated and replaced by the female portion 166 of a button snap set located adjacent the left side seam 28. When flotation device 10 is placed into its folded configuration, the female portion 166 can be brought into alignment with male portion 164 and lockingly engaged to hold flotation device 10 in its folded configuration.

Figure 5:
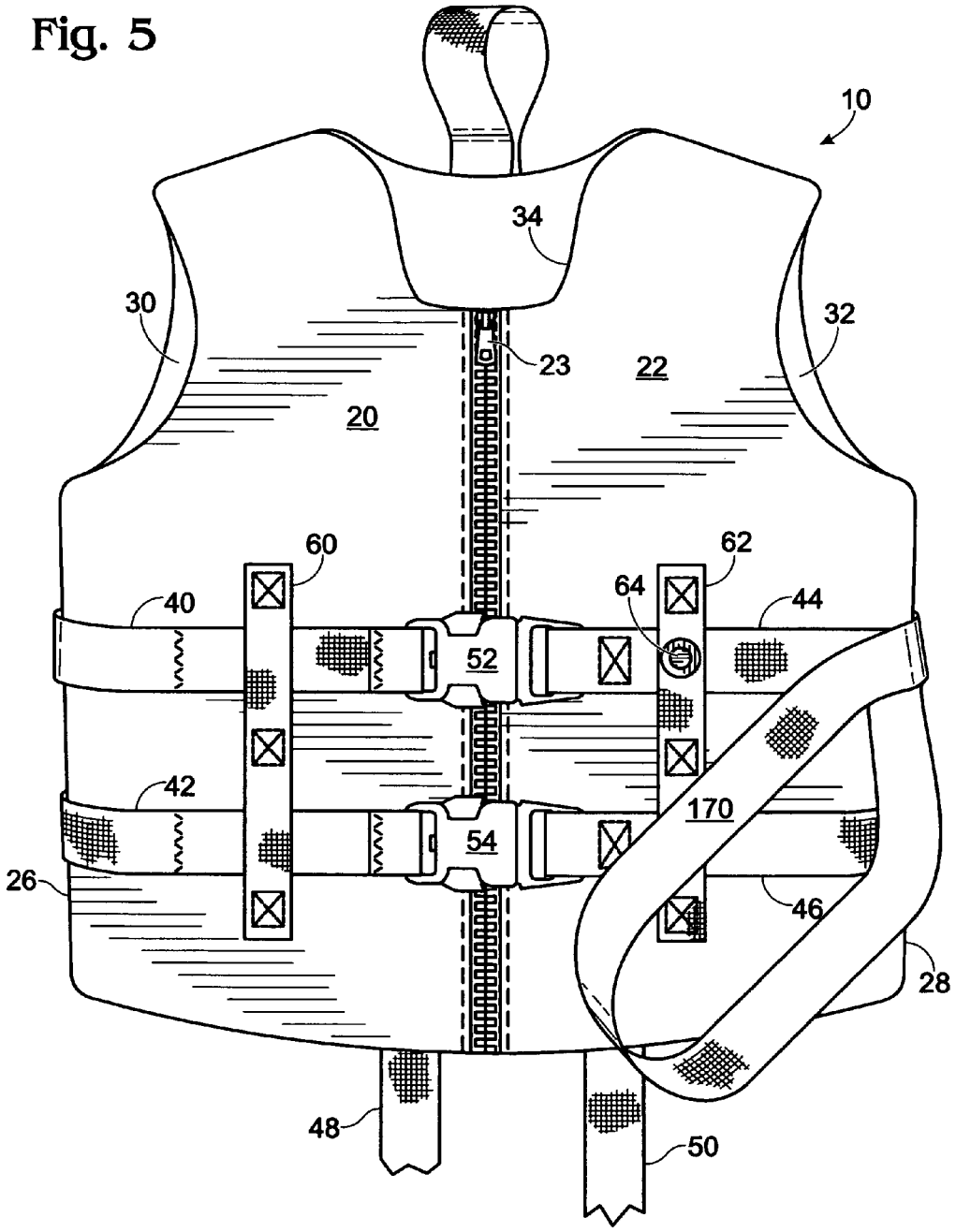
FIG. 5 is a view of the front side of a vest type flotation device incorporating the third embodiment of the transport and storage holding means of the present invention.

A third embodiment of the present invention is shown in FIG. 5. In this embodiment strap 70 of the first embodiment has been eliminated and replaced by an elastic loop 170. When flotation device 10 is folded, elastic loop 170 can be stretched and looped around the folded device to hold it in its folded configuration.

It will be obvious to those having skill in the art that many changes may be made to the details of the above-described embodiments of this invention without departing from the underlying principles thereof. The scope of the present invention should, therefore, be determined only by the following claims.

The invention claimed is:

1. An apparatus, comprising:

a flotation device having a right side portion including a first portion of a back member and a right front portion of the flotation device, the flotation device having a left side portion including a second portion of the back member and left front portion, the right front portion and the first portion of the back member collectively defining a right arm opening, the left front portion and the second portion of the back member collectively defining a left arm opening, the flotation device being movable between (1) a use configuration in which a user can wear the flotation device and the user can place the user's right arm through the right arm opening and the user's left arm through the left arm opening, and (2) a folded configuration in which the flotation device is folded along a longitudinal centerline of the flotation device and the right arm opening is disposed closer to the left arm opening than when in the use configuration;

a first strap member coupled to the right side portion of the floatation device;

a second strap member coupled to the left side portion of the floatation device;

a first releasable connector coupled to an end portion of the first strap member;

a second releasable connector coupled to an end portion of the second strap member, the first releasable connector configured to be releasably coupled to the second releasable connector when the flotation device is in the use configuration;

a first portion of a releasable locking member coupled to one of the first strap member and the second strap member; and a second portion of the releasable locking member coupled to the other of the first strap member and the second strap member, the second portion of the releasable locking member configured to releasably engage the first portion of the releasable locking member when the flotation device is moved to the folded configuration to maintain the flotation device in the folded configuration.

2. The apparatus of claim 1, wherein the first portion of the releasable locking member includes a male connector and the second portion of the releasable locking member includes a mating female connector.

3. The apparatus of claim 1, wherein the first portion of the releasable locking member includes a female connector and the second portion of the releasable locking member includes a male connector.

4. The apparatus of claim 1, wherein the first portion of the releasable locking member is a first portion of a button snap connector and the second portion of the releasable locking member is a second portion of a button snap connector.

5. The apparatus of claim 1, further comprising:

a zipper having a first interlocking portion coupled to the right front portion and a second interlocking portion coupled to the left front portion, the first interlocking portion and the second interlocking portion are collectively configured to couple the right front portion to the left front portion.

6. The apparatus of claim 1, further comprising:

a third strap member coupled to the right front portion; and a fourth strap member coupled to the left front portion, the third strap member being releasably couplable to the fourth strap member.

7. The apparatus of claim 1, further comprising:

a first leg strap and a second leg strap each coupled to the flotation device.

8. The apparatus of claim 1, wherein:

the first portion of the releasable locking member is fixedly attached to the one of the first strap member and the second strap member; and the second portion of the releasable locking member is fixedly attached to the other of the first strap member and the second strap member.

9. An apparatus, comprising:

a flotation device having (1) a right side portion including a first portion of a back member and a right front portion, and (2) a left side portion including a second portion of the back member and the left front portion, the flotation device being movable between a use configuration in which a user can wear the flotation device and a folded configuration for transport and storage;

a first strap member coupled to the right side portion of the floatation device;

a second strap member coupled to the left side portion of the floatation device;

a first releasable connector coupled to an end portion of the first strap member;

a second releasable connector coupled to an end portion of the second strap member;

a third strap member coupled to one of the right side portion of the flotation device and the left side portion of the flotation device;

a first portion of a releasable locking member coupled to the third strap member;

a second portion of the releasable locking member coupled to one of the right front portion and the left front portion, the first portion of the releasable locking member configured to releasably engage the second portion of the releasable locking member when the flotation device is in the use configuration; and a third portion of the releasable locking member coupled to the other of the one of the right front portion and the left front portion, the first portion of the releasable locking member configured to releasably engage the third portion of the releasable locking member when the flotation device is in the folded configuration to maintain the flotation device in the folded configuration, the first portion of the releasable locking member being configured to matingly engage the second portion of the releasable locking member and the third portion of the releasable locking member but not matingly engage the first releasable connector and the second releasable connector.

10. The apparatus of claim 9, wherein the first portion of the releasable locking member includes a male connector and the second portion and the third portion of the releasable locking member each includes a female connector.

11. The apparatus of claim 9, wherein the first portion of the releasable locking member includes a female connector and the second portion and the third portion of the releasable locking member each includes a male connector.

12. The apparatus of claim 9, wherein the first portion of the releasable locking member includes a first portion of a button snap connector, and the second portion and the third portion of the releasable locking member each includes a second portion of the button snap connector.

13. The apparatus of claim 9, wherein the third strap member has a length such that when the flotation device is in the folded configuration the third strap member can wrap at least partially around the flotation device and the first portion of the releasable locking member can engage the third portion of the releasable locking member.

14. The apparatus of claim 9 wherein the right front portion and the left front portion are couplable to each other with a releasable attachment mechanism.

15. The apparatus of claim 9, wherein the right front portion and the left front portion are couplable to each other with a zipper.

* * * * *